United States Patent [19]

Van Der Wilk

[11] Patent Number: 4,669,994

[45] Date of Patent: Jun. 2, 1987

[54] METHOD OF MANUFACTURING A CATHODE RAY TUBE

[75] Inventor: Ronald Van Der Wilk, Eindhoven, Netherlands

[73] Assignee: U.S. Philips Corporation, New York, N.Y.

[21] Appl. No.: 837,640

[22] Filed: Mar. 10, 1986

[30] Foreign Application Priority Data

Mar. 19, 1985 [NL] Netherlands ..... 8500786

[51] Int. Cl.[4] ..... H01J 9/42

[52] U.S. Cl. ..... 445/3; 324/208

[58] Field of Search ..... 445/3, 34, 63; 324/207, 324/208

[56] References Cited

U.S. PATENT DOCUMENTS

| | | | |
|---|---|---|---|
| 4,181,884 | 1/1980 | Shirasaki et al. | 324/208 |
| 4,189,659 | 2/1980 | Andre et al. | 445/3 |
| 4,189,814 | 2/1980 | Ottos | 445/34 X |
| 4,211,960 | 7/1980 | Barten et al. | 315/368 X |
| 4,220,897 | 9/1980 | Barten et al. | 315/368 |

FOREIGN PATENT DOCUMENTS

| | | | |
|---|---|---|---|
| 154001 | 9/1982 | Japan | 324/207 |
| 42746 | 3/1984 | Japan | 445/3 |
| 123611 | 10/1984 | Japan | 445/3 |
| 1540817 | 2/1979 | United Kingdom . | |

*Primary Examiner*—Kenneth J. Ramsey
*Attorney, Agent, or Firm*—Robert J. Kraus

[57] ABSTRACT

A method of manufacturing a cathode ray tube which comprises an envelope portion (1) having a longitudinal axis (8) and a gun assembly (32) having a longitudinal axis (8), in which:

a. the envelope portion (1) is fixed in an assembly device (30,31) in a given position, b. the gun assembly (32) is provided in the envelope portion (1), the axes (8) substantially coinciding, c. the location and/or the orientation of the gun assembly (32) is adjusted with respect to the axis of the envelope (1), and d. the gun assembly is secured in the envelope. The adjustment of step c is carried out by means of a structure (15), connected to the gun assembly (32), which consists of magnetically half hard material and is magnetized as a multipole, and by means of a device having magnetic field-sensitive sensors (20, 21, 22, 23) provided around the envelope (1) at the level of the structure (15). The desired location and orientation of the gun assembly is adjusted by rotating and translating (x, y) the gun assembly and observing the field observed by the sensors (20, 21, 22, 23), after which the gun assembly is secured in the envelope, and after which the structure is preferably demagnetized. As a result of this a very accurate adjustment in the tube is obtained.

4 Claims, 4 Drawing Figures

METHOD OF MANUFACTURING A CATHODE RAY TUBE

BACKGROUND OF THE INVENTION

The invention relates to a method of manufacturing a cathode ray tube, which tube comprises an envelope portion having a longitudinal axis and a gun assembly having a longitudinal axis, in which a. the envelope portion is fixed in an assembly device in a given position,
b. the gun assembly is provided in the envelope portion, the said axes substantially coinciding,
c. the location and/or the angle orientation of the gun assembly is adjusted with respect to the axis of the envelope portion and portion;
d. the gun assembly is secured in the envelope.

Such a cathode ray tube may be a television camera tube or a display tube. Display tubes have a wide field of application. They are used, for example, as projection television display tubes, oscilloscope tubes, colour display tubes and DGD-tubes (DGD=Data Graphic Display). All these types of tube comprise an electron gun system for generating at least one electron beam. This electron beam must enter the deflection fields in a precise manner and must land at a precise location on a target, such as a display screen, in the tube. A very accurate assembly of the electron gun system in the envelope during the manufacture of the tube is therefore necessary.

Such a method is known from U.S. Pat. No. 3,807,006 in which the assembly is described of a gun assembly in the envelope of a colour display tube. The mechanical adjustment preceding the assembly as described in the patent is not sufficiently accurate. When providing the gun assembly in the tube neck, the accurate adjustment is often lost. Therefore, French Patent Application No. 7704772 (corresponding to British Patent Application 1,560,199) describes an optical alignment of the gun assembly in the tube neck. For that purpose, gun electrodes must be provided with extra apertures through which, during the adjustment, a light beam passes which is then detected. A disadvantage of this method is that, during the adjustment, the light beam passes two times through an often curved part of the envelope, as a result of which errors are introduced.

SUMMARY OF THE INVENTION

It is therefore an object of the invention to provide a method which is very accurate and in which it is not necessary to provide extra apertures in the electrodes of the electron gun and in which during the adjustment the envelope does not constitute an obstruction.

According to the invention, a method of the kind mentioned in the opening paragraph is characterized in that the adjustment (according to step c) is carried out by means of a structure of magnetically half hard material magnetized as a multipole and a device with magnetic field-sensitive sensors which is provided around the envelope portion at the level of the structure. The desired location and orientation of the gun assembly is adjusted by rotating and translating the gun assembly and observing the field observed by the sensors, after which the gun assembly is secured in the envelope and the structure is preferably demagnetized.

Because the structure has to be demagnetized following adjustment, the material must be magnetically half hard so as to be able to be easily magnetized and demagnetized afterwards. Very suitable is a structure such as a ring or a number of blocks of an alloy of Fe, Co, V, and Cr (known under the tradename of Vicalloy) or of the material as is described in German Patent Specification No. 2,612,607 (corresponding to British Patent Application No. 1,540,817). The structure is magnetised as a multipole. Most suitable is a quadrupole. A higher order pole circulating along the structure, changes polarity often, but the field has a smaller amplitude than in a quadrupole. The gradient in the field at a point where the polarity is inverted is not larger than in a quadrupole.

The tangential and/or radial field is measured by means of a number of magnetic field sensors and the output from the sensors is controlled to zero by rotation of the gun. The signal of two sensors positioned at right angles to a displacing device may be used to measure the eccentricity of the gun and to adjust it to zero.

A first preferred embodiment of the invention is characterized in that the structure of magnetically half hard material is a ring secured to the gun assembly and magnetised as a quadrupole. During the adjustment four magnetic field-sensitive sensors are provided at the level of the ring around the envelope portion.

A second preferred embodiment of the invention is characterized in that the cathode ray tube is a colour display tube and the gun assembly comprises three electron guns for generating three electron beams. The ring which, during the adjustment, is magnetised as a quadrupole is provided around the electron beam paths near the gun ends, the gun assembly being secured in the envelope, after which the ring is demagnetized and then magnetized in known manner as a multipole.

Such a colour display tube is disclosed in U.S. Pat. No. 4,211,960 and German Patent No. 2,612,607 which may be considered to be incorporated herein by reference. These patents describe a colour display tube in which deviations from the frame shape, the colour purity, and the static convergence are corrected by magnetizing a ring of a magnetizable material connected to the electron gun, as a result of which a static magnetic multipole field is formed around the paths of the electron beams. This ring is magnetized only in the finished tube. In these tubes it is possible to magnetise the ring, before the gun is connected in the tube, as a quadrupole and then to direct the gun according to the invention in the tube envelope by means of the magnetic field sensors. After connecting the gun and finishing the tube, the ring is demagnetised and then again magnetised as a multipole for the correction of deviations of the frame shape, the colour purity, and the static convergence. The magnetisation as a quadrupole may be carried out by means of the method described in U.S. Pat. No. 4,220,897 which may be considered to be incorporated herein by reference. Because the accuracy of the strength of the quadrupole is less important, the magnetisation of the quadrupole, however, may also be done differently.

BRIEF DESCRIPTION OF THE DRAWING

An embodiment of the invention will now be described in greater detail, by way of example, with reference to the drawing figures, in which.

DESCRIPTION OF THE PREFERRED EMBODIMENT

Figure 1:
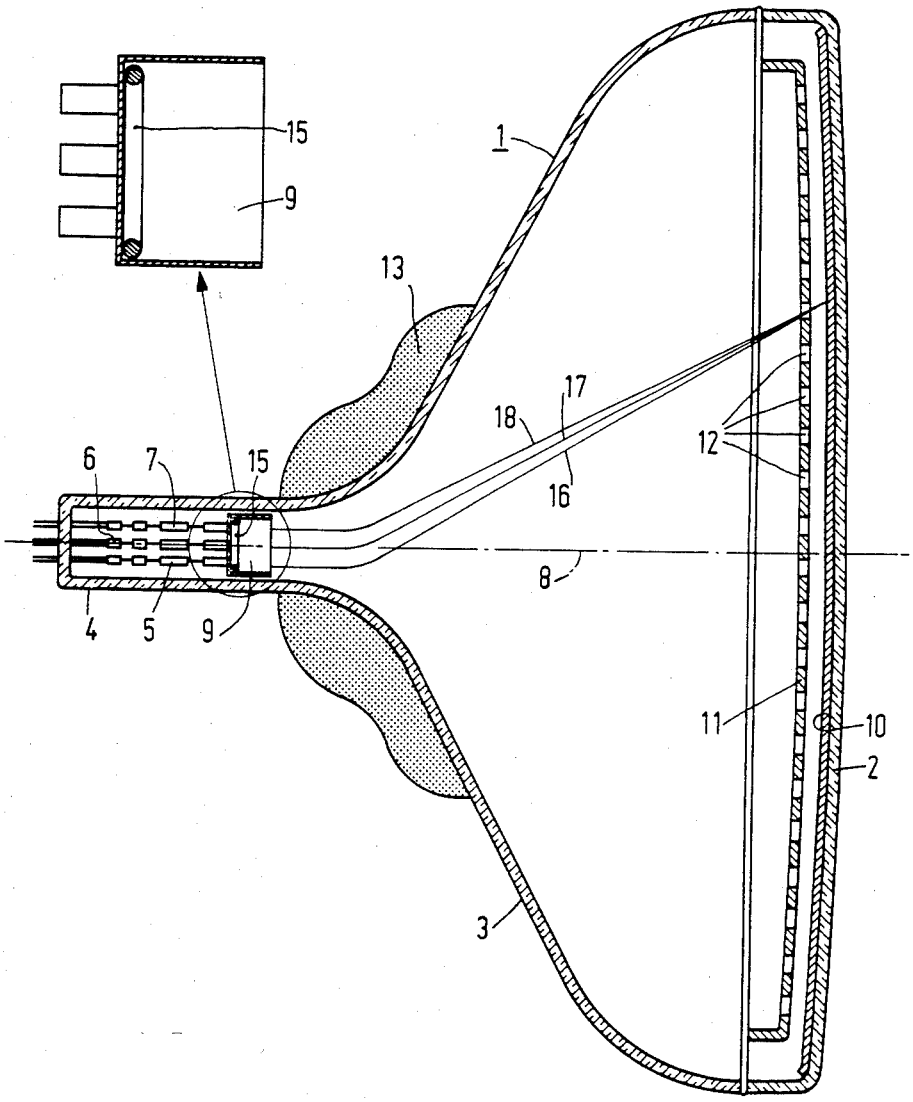
FIG. 1 is a longitudinal sectional view of a colour display tube of the "in-line" type.

FIG. 1 is a diagrammatic longitudinal sectional view of a known colour display tube of the "in-line" type. Three electron guns 5, 6 and 7, which generate three electron beams 16, 17, 18, are assembled in the neck 4 of a glass envelope which consists of a display window 2, a funnel-like part 3, and the neck 4. The axes of the electron guns open into a sleeve 9 which is situated coaxially in the neck 4. The display window comprises a large number of triplets of phosphor lines on its inside. Each triplet comprises a line consisting of a green-luminescing phosphor, a line consisting of a blue-luminescing phosphor, and a line consisting of a red-luminescing phosphor. All triplets together constitute the display screen 10. The phosphor lines extend at right angles to the plane of the drawing. The shadow mask 11 in which a very large number of elongate apertures 12 are provided through which the electron beams pass, is provided in front of the display screen. The electron beams 16, 17, 18 are deflected in the horizontal direction (in the plane of the drawing) and in the vertical direction (at right angles thereto) by the system of deflection coils 13. The three electron guns are assembled so that their axes enclose a small angle with each other. As a result of this the generated electron beams 16, 17, 18 pass through the apertures 12 at the angle, which is called the colour selection angle, and each beam impinges only on phosphor lines of one colour. A display tube has a good static convergence if the three electron beams, when they are not deflected, intersect each other substantially in the centre of the display screen. It has been found, however, that the static convergence often is not good, as well as the frame shape and the colour purity, which may be the result of an insufficiently accurate gun assembly and/or fixing of the electron guns in the neck of the tube. The present invention provides a solution to the problem of inaccurate gun assembly in the envelope. A ring 15 of an alloy of Fe, Co, V and Cr (known under the tradename of Vicalloy) is provided on the bottom of sleeve 9. By magnetising the said ring in the finished tube so that it causes a correction field, the errors in the convergence, the colour purity, and the frame of the displayed picture can be eliminated for the greater part. This is described in greater detail in the U.S. Pat. No. 4,220,897. However, this ring 15 may also be used fruitfully in the gun assembly.

The method according to the invention will now be described further with reference to FIG. 2. The envelope 1 is fixed in an assembly device in a given position. This is shown diagrammatically by means of the positioning studs 30 and 31. The electron gun assembly 32 consists of the electron guns 5, 6 and 7 the components of which are connected together by glass rods 34. The guns are assembled on a glass plate 19 by means of connection wires 35 which are connected to the connection pins 36 sealed in the glass plate 19. The guns open into sleeve 9. On the bottom of sleeve 9, the ring 15 of a magnetisable material is connected which in this case is magnetised as a quadrupole. The gun assembly 32 is placed in a holder 33 by its pins 36, the holder forming part of the assembly device.

Figure 2:
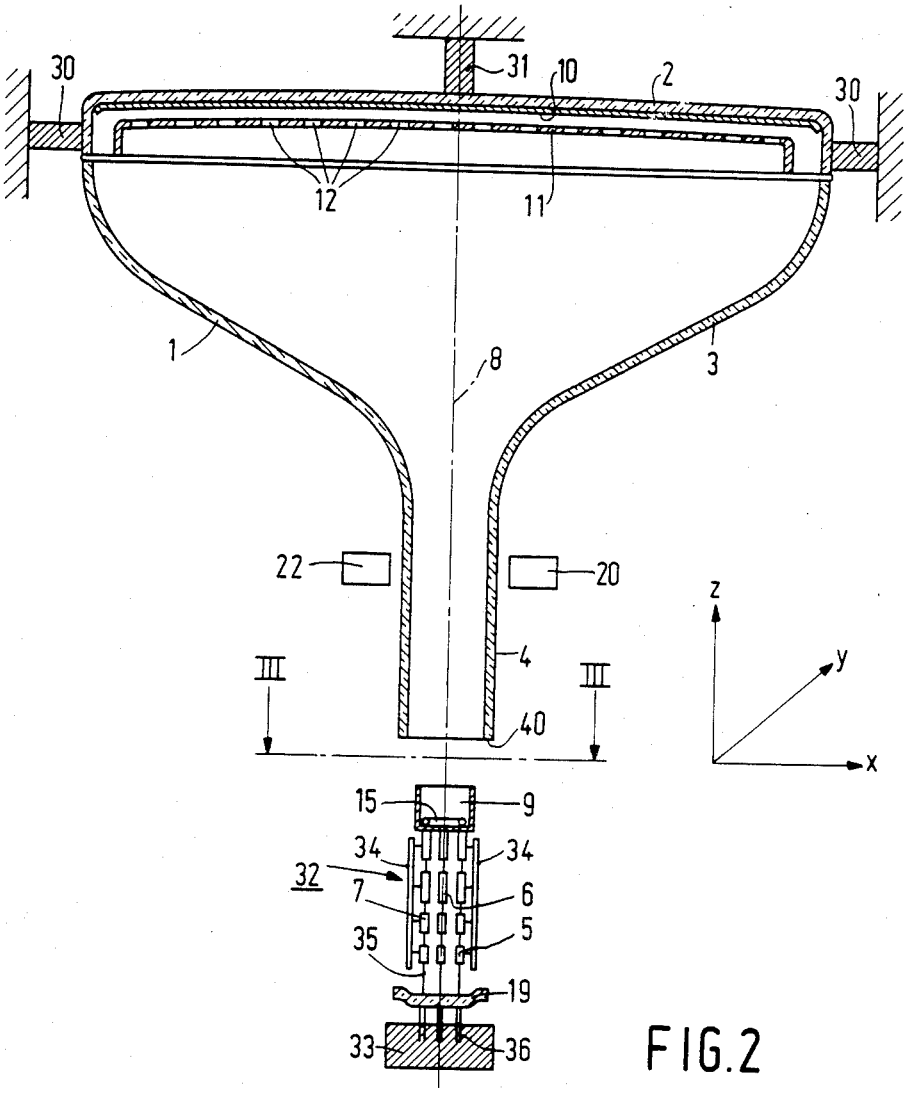
FIG. 2 shows the assembly according to the invention with reference to a longitudinal sectional view of the tube not yet assembled.
Figure 3:
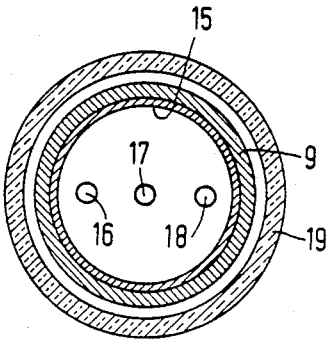
FIG. 3 is a cross-sectional view of FIG. 2.

FIG. 3 is a cross-sectional view of FIG. 2. Ring 15 is connected on the bottom of sleeve 9 around the three apertures through which the electron beams 16, 17, 18 pass.

Figure 4:
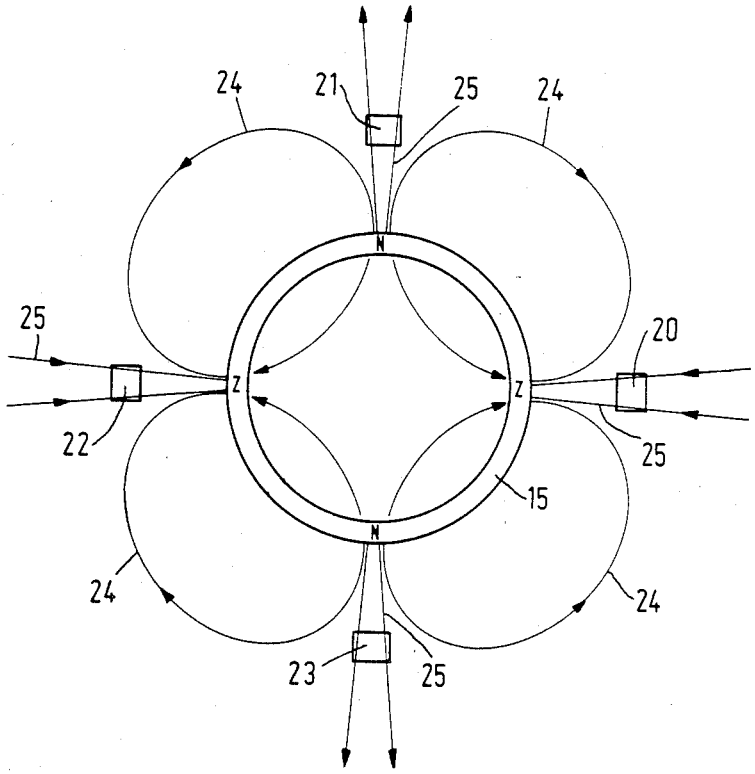
FIG. 4 shows diagrammatically a ring magnetised as a quadrupole and the location of the magnetic field sensors.

The electron gun assembly 32 is provided in the envelope 1 with its central axis substantially coincident with the longitudinal axis of the envelope 1, referenced 8, and the location and orientation of the electron gun assembly in the envelope is adjusted. The tangential magnetic field 24 or the radial magnetic field 25 (see FIG. 4) of the ring 15 magnetised as a quadrupole is measured by means of four magnetic field sensors 20, 21, 22, 23 (for example, magneto-restrictive sensors such as the type MRS-A of Philips) spaced around the neck at 90° intervals in a plane transverse of the axis 8 and parallel with the plane of the ring 15, and in a predetermined position with respect to the assembly device and thus the envelope 1. A few field lines 24 and 25 of this field are shown. By rotating the gun around the axis 8 the total field measured by the sensors is adjusted to a total sensor output of zero. The gun assembly is adjusted correctly if the field through the sensor 20 plus the field through the sensor 21 plus the field through the sensor 22 plus the field through the sensor 23 together is zero. This adjustment can be done with an accuracy of less than 5'. The signal of two sensors which are at right angles to a direction of displacement may be used to fix the eccentricity and adjust it to zero by translating in the x and/or y direction. After aligning, plate 19 is sealed to the neck end 40 (FIG. 2). The ring 15 is then demagnetised and magnetised again to obtain the aforementioned convergence correction field.

The invention is not restricted to use in colour display tubes, although the use in such tubes is, of course, very attractive where a magnetisable ring is already present. The invention may also be applied to, for example, camera tubes in which the ring is demagnetised after assembly and is not used any more for electron-optical purposes. The use of another magnetisable structure is also possible as well as the use of a multipole other than a quadrupole.

What is claimed is:

1. A method of manufacturing a cathode ray tube, which tube comprises an envelope portion having a longitudinal axis and a gun assembly having a longitudinal axis, in which:

a. the envelope portion is fixed in an assembly device in a given position, b. the gun assembly is provided in the envelope portion, said axes substantially coinciding, c. the location and/or the angle orientation of the gun assembly is adjusted with respect to the axis of the envelope portion, and d. the gun assembly is secured in the envelope, characterized in that the adjustment of step c is carried out by means of a structure of magnetically half hard material magnetized as a multipole and a device with magnetic field-sensitive sensors which is provided around the envelope portion at the level of the structure, the desired location and orientation of the gun assembly being adjusted by rotating and translating the gun assembly and observing the field observed by the sensors, after which the gun assembly is secured in the envelope.

2. A method as claimed in claim 1, characterized in that the structure magnetized as a multipole is demagnetized following said adjustment.

3. A method as claimed in claim 1 or 2, characterized in that the structure of magnetically half hard material is a ring connected to the gun assembly, which ring is magnetized as a quadrupole, and during the adjustment four magnetic field-sensitive sensors are provided around the envelope portion in a regular manner.

4. A method as claimed in claim 3, characterized in that the cathode ray tube is a colour display tube and the gun assembly comprises three electron guns for generating three electron beams, in which the ring which during the adjustment is magnetized as a quadrupole is provided around the electron beam paths near the gun ends, the gun assembly being secured in the envelope, after which the ring is demagnetized and then magnetized in known manner as a multipole.

* * * * *